US012467337B2

(12) United States Patent
Fripp et al.

(10) Patent No.: US 12,467,337 B2
(45) Date of Patent: Nov. 11, 2025

(54) AUTONOMOUS WELLBORE CLEANING SYSTEM

(71) Applicant: Halliburton Energy Services, Inc., Houston, TX (US)

(72) Inventors: Michael Linley Fripp, Singapore (SG); Mark S. Holly, Singapore (SG); Wei Zhang, Houston, TX (US); Aswin Balasubramanian, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 18/450,922

(22) Filed: Aug. 16, 2023

(65) Prior Publication Data

US 2025/0059853 A1 Feb. 20, 2025

(51) Int. Cl.
*E21B 37/02* (2006.01)
*E21B 47/00* (2012.01)

(52) U.S. Cl.
CPC ..... *E21B 37/02* (2013.01); *E21B 47/006* (2020.05)

(58) Field of Classification Search
CPC ..... E21B 37/02; E21B 47/006
See application file for complete search history.

(56) References Cited

U.S. PATENT DOCUMENTS 5,458,200 A 10/1995 Lagerlef et al.
6,070,608 A 6/2000 Pringle
6,343,651 B1 2/2002 Bixenman
6,446,718 B1 9/2002 Barrett et al.
6,799,633 B2 10/2004 McGregor
7,303,010 B2 12/2007 De Guzman et al.
7,322,416 B2 * 1/2008 Burris, II ..... E21B 47/04 175/45
8,525,124 B2 * 9/2013 Atwood ..... G01N 35/00 356/241.6
8,528,395 B2 9/2013 Groffiths et al.
10,378,339 B2 * 8/2019 Costa De Oliveira . E21B 47/26
10,459,107 B2 10/2019 Pelletier et al.
10,563,478 B2 2/2020 Arsalan et al.
10,570,696 B2 2/2020 Arsalan et al.
10,612,370 B2 4/2020 Bouldin et al.
10,641,060 B2 5/2020 Arsalan et al.
10,655,429 B2 5/2020 Arsalan et al.
10,724,329 B2 7/2020 Arsalan et al.
10,781,660 B2 9/2020 Arsalan et al.
10,907,442 B2 2/2021 Arsalan et al.
(Continued)

OTHER PUBLICATIONS

"PCT Application No. PCT/US2023/072380, International Search Report and Written Opinion", May 8, 2024, 14 pages.

*Primary Examiner* — Aaron L Lembo
(74) *Attorney, Agent, or Firm* — DeLizio, Peacock, Lewin & Guerra LLP

(57) ABSTRACT

Disclosed herein are an apparatus, system, and method directed for an autonomous wellbore cleaner. In one embodiment, an apparatus for cleaning a wellbore, the apparatus comprising: an autonomous robot, wherein the robot is self-propelled; a power source for the robot; a motor for propelling the robot axially within the wellbore; at least one cleaning tool positioned on the robot; at least one sensor to detect an initiate-cleaning attribute downhole in the wellbore; and a processor to direct the robot to initiate a cleaning operation in response to the initiate-cleaning attribute exceeding a threshold.

20 Claims, 10 Drawing Sheets

(56) References Cited

U.S. PATENT DOCUMENTS

| | | | | |
|---|---|---|---|---|
| 11,008,822 | B2 | 5/2021 | Fernandes et al. | |
| 11,047,189 | B2 | 6/2021 | Fernandes et al. | |
| 11,293,266 | B2 | 4/2022 | Bowman | |
| 11,566,494 | B2 | 1/2023 | Greci et al. | |
| 11,608,717 | B2 * | 3/2023 | Lehrling | E21B 23/06 |
| 11,931,779 | B2 * | 3/2024 | Ahmari | E21B 37/02 |
| 11,939,860 | B2 * | 3/2024 | Seren | E21B 47/138 |
| 2009/0151936 | A1 | 6/2009 | Greenaway | |
| 2020/0248517 | A1 | 8/2020 | Bouldin et al. | |
| 2021/0123335 | A1 | 4/2021 | Jabari et al. | |
| 2022/0243560 | A1 | 8/2022 | Al-Huwaider et al. | |
| 2023/0399938 | A1 * | 12/2023 | Hernandez de la Bastida | E21B 37/06 |
| 2023/0407726 | A1 * | 12/2023 | Pitchon Sampaio | E21B 37/06 |
| 2024/0279993 | A1 * | 8/2024 | Fripp | B60L 53/50 |
| 2024/0280012 | A1 * | 8/2024 | Gunter | G01K 3/14 |
| 2024/0328302 | A1 * | 10/2024 | Hu | E21B 43/128 |
| 2024/0337181 | A1 * | 10/2024 | Havre | E21B 47/07 |
| 2024/0344431 | A1 * | 10/2024 | Gupta | E21B 41/04 |

* cited by examiner

AUTONOMOUS WELLBORE CLEANING SYSTEM

TECHNICAL FIELD

The disclosure generally relates to wellbore completions and, more particularly, to downhole tools for performing wellbore cleaning operations.

BACKGROUND

In completed wellbores, debris from drilling, completion, and/or production operations can be removed using downhole tools having deployable scrapers. Generally, cleaning tools are included as part of a wellbore cleaning system and are run into the wellbore. Once positioned in the wellbore, the cleaning tool can be deployed to be in contact with an interior of a casing of the wellbore and, traditionally, the cleaning tool is then pulled out of hole.

BRIEF DESCRIPTION OF THE DRAWINGS

Embodiments of the disclosure may be better understood by referencing the accompanying drawings.

DETAILED DESCRIPTION OF EMBODIMENTS

Figure 1:
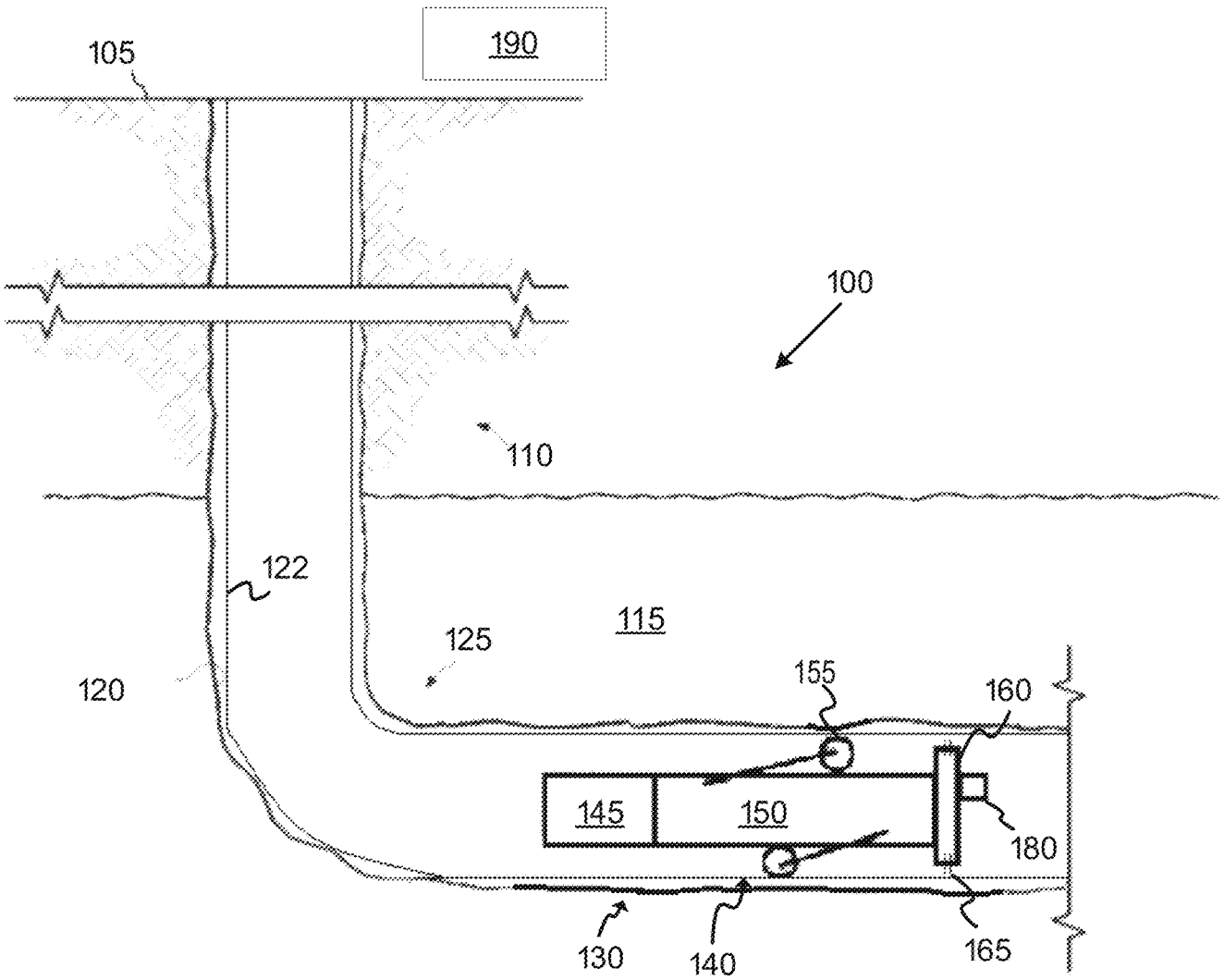
FIG. 1 is a partial cross-sectional view of a wellbore with one example wellbore cleaning device, according to some embodiments.

The description that follows includes example systems, methods, techniques, and program flows that embody embodiments of the disclosure. However, it is understood that this disclosure may be practiced without these specific details. For instance, this disclosure refers to cleaning an interior of a casing or production tubing of a wellbore in illustrative examples. Embodiments of this disclosure can also be applied to cleaning of production tubing disposed within a cased wellbore. In other instances, well-known instruction instances, protocols, structures and techniques have not been shown in detail in order not to obfuscate the description.

When performing wellbore cleanout operations, it is common to run in cleaning tools downhole in a trip separate from other steps of the cleanout operation. In addition to extending the time required to perform wellbore cleaning operations, conventional downhole cleaning tools can be limited to a single activation cycle and may require multiple downhole trips and multiple cleaning tools if more than one cleaning/scraping operation is required. In contrast to conventional cleaning tools, example embodiments include an autonomous wellbore cleaning device, having an autonomous robot, or tractor, which may be combined with a cleaning tool/scale removal subassembly. The cleaning tool/scale removal subassembly may be a brush, a pump shooting a jet of well fluid at the scale, or a sonic or acoustic cleaning tool. A sensor positioned on the wellbore cleaning device may detect scale buildup within the wellbore and may indicate that scale removal/cleaning may be needed, and may also allow for adjusting the speed of the robot and the power delivered to the scale removal subassembly.

Further disclosed herein is a method for removing scale and asphaltenes from a wellbore. An autonomous robot/tractor of the wellbore cleaning device allows for more frequent cleaning and periodic scale removal. More frequent cleaning enables the removal of an easier to remove thin layer of scale rather than a more robust extended layer of scale. Example systems and method disclosed herein also include protecting the robot from becoming debilitated from scale forming on the robot surface or on the mechanical components and workings of the robot.

Scale may also form on the surface of the autonomous robot. The disclosure provides features within the wellbore than can be used to help remove the scale that can form on the surface of the robot. In some examples, the robot scale removal is associated with a downhole charging station or with a parking location for the robot. Brushed or other cleaning tools may also be positioned within the wellbore to remove scale from the robot as the robot moves axially within the wellbore. Embodiments of an autonomous cleaning device provided herein differ from traditional pipeline pigs, at least for the reasons that pipeline pigs are not self-propelled and do not go downhole. Further, embodiments of an autonomous cleaning device differ from industry standard workover tools at least because workover tools are tethered and are not autonomous.

Embodiments of the autonomous wellbore cleaning device may "live"/remain within a wellbore completion and can periodically traverse the completion in order to remove any fouling and scale that would be building on the permanent completion. The completion may include a docking station, and in some embodiments, may include a pocket for housing the wellbore cleaning device and may also provide a charging station for recharging the power source or power supply of the robot. The timely removal of the fouling/scale is advantageous because it is much easier to remove a thin layer of scale than it is to remove a thick layer of scale. Whether being removed from the wellbore by the autonomous wellbore cleaning device or cleaning the autonomous wellbore cleaning device itself, the scale is being removed by providing a mechanical stress on the scale that causes the scale to lose adhesion to the interior surfaces of the wellbore such as, e.g., tubing.

Embodiments of the autonomous wellbore cleaning device include an autonomous robot that is self-propelled. In some embodiments, the robot may be untethered once the cleaning device is positioned downhole. There may be a power source for the robot, a motor for propelling the robot axially within the wellbore, and at least one cleaning tool positioned on the robot. At least one sensor may be positioned on or about the robot to detect an initiate-cleaning attribute downhole in the wellbore, and a processor may be configured to direct the robot to initiate or adjust a cleaning operation in response to the initiate-cleaning attribute exceeding a threshold. The processor may be positioned on the robot, may be positioned uphole or at the surface of the wellbore, or at a remote location.

The at least one sensor may be a scale sensor used to adjust the rate of movement of the tractor/robot or the amount of energy or pressure being applied to the scale removal. Because the autonomous wellbore cleaning device is untethered, the wellbore cleaning device may have a limited energy supply. As such, using the at least one scale sensor to determine an initiate-cleaning attribute, such as a predetermined amount of scale buildup or determining certain cleaning intervals may help conserve the energy of the cleaning device. For example, a standard coiled tubing-style approach where the entire tubing string is blasted is less useful with a self-powered robot because these that approach would quickly drain the batteries or would require frequent recharging. In contrast, a standard pipeline pig has substantial energy from the pumping forces and, thus, does not need to modulate its cleaning force. With a self-propelled tool, the wellbore can be cleaned more quickly if the cleaning time is spent on the section of the wellbore where scale has formed rather than spending time equally on all sections of the wellbore. The sensor may also be a restriction sensor used to detect any restrictions impeding movement of the cleaning device, wherein the initiate-cleaning attribute may indicate that movement of the robot has slowed down by a predetermined amount, indicating impediments to the robot's movement, such as scale buildup or fouling within the inner diameter of the wellbore. The sensor may also be an electrical sensor that detects the electrical resistance of the surface of the inner diameter of the wellbore such as with contact resistance sensor or an AC electromagnetic measurement. The initiate-cleaning attribute may be a resistance, inductance, or capacitive measurement.

Embodiments of the autonomous cleaning tool may include different tools used for scale removal. In some embodiments, the tool may be one or more brushes for scale removal. Some embodiments of the autonomous cleaning tool may also include a motor and water jet and a scale removal head. In one embodiment, scale is removed with a pump that blasts water at the wall. In addition to using a fluid, some embodiments may include a sonic cleaner. The sonic cleaner uses acoustic energy to remove the scale. Examples of the sonic cleaner may be a separate tool that can be collected by the robot/tractor, but may also be integral to the robot/tractor.

Alternative embodiments may include the ability for scale removal from the autonomous cleaning device itself. If scale is likely to form on the wall of the inner diameter of the wellbore, or tubing within the wellbore, then scale is likely to form on the wall of the robot. If the robot is going to dwell within the wellbore for long periods of time, then a device/system to remove scale from surfaces of robot is needed, as well as from the drive mechanisms of the robot. The wellbore may be outfitted with tools for scale and debris removal from the robot/tractor. In one case, the wellbore is outfitted with wire brushes. The robot drives through the brushes and the brushes scrape along the wall of the robot and remove scale. In another variation, the flow entering the production tubing is configured to form a jet. This jet can arise from a nozzle, a vortex, a fluidic oscillator, or equivalent. Ideally, the jet impinges at an angle to the robot. The jet removes the scale. In addition to using a fluid, some embodiments may include a sonic cleaner. The sonic cleaner uses acoustic energy to remove the scale. As shown in the figure, the sonic cleaner may be a separate tool that can be collected by the robot, but may also be integral to the robot.

Example System

Referring to FIG. 1, depicted is a wellbore system 100 including an exemplary operating environment that the apparatuses, systems, and methods disclosed herein may be employed. For example, the wellbore system 100 could use a wellbore robot or tractor according to any of the embodiments, aspects, applications, variations, designs, etc. disclosed in the preceding and/or following paragraphs. The illustrated wellbore system 100 initially includes a wellbore 105. The illustrated wellbore 105 is a deviated wellbore that is formed to extend from a terranean surface 110 to a subterranean zone 115 (e.g., a hydrocarbon bearing geologic formation) and includes a vertical portion 120, a radius portion 125, and a horizontal portion 130. Casing 122 extends from the surface of the wellbore through all of the various portions. Although portions 120 and 130 are referred to as "vertical" and "horizontal," respectively, it should be appreciated that such wellbore portions may not be exactly vertical or horizontal, but instead may be substantially vertical or horizontal to account for drilling operations. The wellbore 105 may be a cased well, a working string or have some sections that may be open hole without a casing.

Further, while the wellbore system 100 depicted in FIG. 1 is shown penetrating the earth's surface on dry land, it should be understood that one or more of the apparatuses, systems and methods illustrated herein may alternatively be employed in other operational environments, such as within an offshore wellbore operational environment for example, a wellbore penetrating subterranean formation beneath a body of water.

In the illustrated embodiment of FIG. 1, a wellbore cleaner 140 manufactured and designed according to the disclosure is positioned within the wellbore 105. The wellbore cleaner 140 may be lowered into the wellbore by a workstring or wireline, but then disconnected from the workstring to remain in the wellbore. The wellbore cleaner 140 may be an autonomous robot or tractor that is self-propelled. The robot or tractor may have features similar to wellbore robots/tractors which may be used in other wellbore applications. In some examples, the wellbore cleaner 140 may be untethered and not physically connected with any features positioned uphole or at the surface of the wellbore 105 once the wellbore cleaner 140 is positioned downhole. The wellbore cleaner 140 may be powered by a power source 145 and include a motor 150. The power source 145, in some embodiments, may be an electric power source, such as a primary battery or a rechargeable battery. In other examples, the power source may include a wired electrical connection to a stationary source of power. The power source may be recharged by an onboard turbine or rotating member of the wellbore cleaner 140, or by a charging station that may be positioned within the wellbore. In some examples, the power source and charging station may have a wired connection with a power source uphole, or in some examples may have a wireless connection with a power source.

The motor 150, in some embodiments, may include one or more wellbore engaging members 155 contactable with an inner surface of the wellbore 105. Accordingly, the one or more wellbore engaging members 155 may displace the wellbore cleaner 140 axially uphole and downhole within the wellbore 105. The wellbore cleaner 140 also includes a mandrel 160. In some embodiments, the mandrel 160 may be stationary, and in other embodiments, the mandrel may include rotating head or turbine, which may also help propel the wellbore cleaner 140 in response to fluid flowing within the wellbore, or rotate one or more cleaning tools coupled thereto.

The wellbore cleaner 140 may include one or more cleaning tools for removing scale from within the wellbore. In this example, the wellbore cleaner 140 includes one or more brushes 165 for scale removal. The brushes 165 may be wire brushes. Wire brushes may be used to remove the scale from the inner diameter (ID) of the wall or casing. The brushes 165 are mounted on a base (not shown) that may be spring-loaded against the mandrel 160). These springs provide a consistent force on the wires of the brushes 165 against the inner wall of the wellbore tubing, even as the wires may be abraded during transit.

In some embodiments, the brushes 165 may be mounted on a base located on a J-slot (not shown) so that the force and position against the inner wall of the wellbore can be changed. When the brush base is in the bottom of the J, then there is the full force against the wall. When the brush base is in the hook of the J, then there is reduced force against the wall. The wellbore cleaner 140 can adjust the position of the brush mount within the J-slot by reversing and then moving forward.

In one variation, the production flow causes the brushes 165 to rotate. The brushes 165 may be connected to a turbine blade. In this example, the mandrel 160 may be a turbine blade. Production flow hits the blades and induces rotation. A shaft connects the rotating blades to brushes 165 so that the brushes 165 will rotate and help to remove the scale from the ID of the wellbore or tubing within the wellbore 105.

In another variation, the mandrel 160 may rotate such that brushes 165 rotate with the mandrel. The motor 150 and wellbore engaging members 155 (may be wheels) may be oriented axially and the motor 150 translates downhole without rotation. The mandrel 160 and brushes 165 may be canted at an angle. The mandrel 160, in some embodiments may also have wheels that are angled such that mandrel 160 and brushes 165 rotate as the motor 150 moves axially. The result is that the brushes 165 may provide additional cleaning of scale. The wheel angle of the mandrel wheels may be adjusted based on how much scale needs to be removed.

The wellbore cleaner 140 may include at least one sensor 180 configured to detect an initiate-cleaning attribute. In some examples, the at least one sensor 180 may be a scale sensor and take surface measurements in the inner diameter based on time, flow rate, or pressure against the wellbore cleaner 140. The sensor 180 may also be an optical integrated computational element (ICE) sensor configured to measure a concentration of salts within the scale and determine that a concentration of the salts have changed over a set period of time, such as, e.g. 15 minutes. The ICE readings may be used to set a cleaning interval based on models, materials within the wellbore, and an accumulation of readings from the sensor 180. The sensor 180 may also be similar to sensors used with logging/measuring while drilling tools.

The initiate-cleaning attribute detected by the sensor 180 may be scale buildup and be used to trigger initiating a cleaning operation, to adjust the rate of movement of the wellbore cleaner 140, or to adjust the amount of energy being applied to the cleaning operation/scale removal. Because wellbore cleaner 140 is self-propelled and in some examples, untethered with any components uphole, the wellbore cleaner 140 may have a limited energy supply. As such, using the at least one sensor 180 may also be used to determine cleaning intervals may help conserve the energy of the cleaning device.

The initiate-cleaning attribute may indicate a buildup of scale with the ID of the wellbore. A processor 190 (shown in this example, positioned at an uphole location) is configured to receive the initiate-cleaning attribute from the sensor 180 and determine if the initiate-cleaning attribute exceeds a predetermined threshold. If the buildup of scale is greater than about 1 mm over greater than 20% of the surface area, the processor may determine that the threshold has been met or exceeded and direct the wellbore cleaner 140 to initiate a cleaning operation. In another example, if the buildup of scale is greater than about 0.5 mm over greater than 50% of the surface area, then the processor may determine that the threshold has been met or exceeded. The threshold determination may be a combination of the depth of the scale and the amount of coverage of the scale. In other examples, the wellbore cleaner 140 may already be moving within the wellbore and initiating a cleaning operation may include adjusting an existing cleaning operation. In some examples, the adjustment may be a change of speed at which the wellbore cleaner is moving within the wellbore, which may include starting movement, slowing movement, or increasing movement or speed. The adjustment may also include an adjustment of cleaning intensity, such as adjusting the pressure applied by the cleaning tools (such as brushes 165), for example to a harder scrub with more pressure, or less pressure for a more gentle scrub. And in some examples, the cleaner 140 may be positioned uphole or at the surface of the wellbore and the initiate-cleaning attribute may indicate that the wellbore cleaner 140 needs to be sent downhole to initiate a cleaning operation.

In other examples, the sensor 180 may also be a restriction sensor used to detect any restrictions impeding movement of the wellbore cleaner 140. The initiate-cleaning attribute may indicate the wellbore cleaner has slowed in movement speed by at least 20%. In one embodiment, the sensor 180 detects any restrictions impeding the advance of the wellbore cleaner 140. This restriction sensor may measure the force needed to advance the wellbore cleaner 140. In one embodiment, the force between the wellbore engaging members 155 (drive wheels of the motor 150) and the cleaning tool (brushes 165) may be measured. In another embodiment, the power needed to drive the wellbore engaging members 155 (drive wheels of the motor 150) may be measured. The sensor 180 may also be an electrical sensor that detects the electrical resistance of the surface of the wellbore tubing such as with contact resistance sensor or an AC electromagnetic measurement. As such, the initiate-cleaning attribute and threshold may be a specified electrical resistivity, such as resistivity greater than 0.0001 ohmmeter. The threshold may be a specified change in electrical resistivity, such as the resistivity increasing by 2×. The threshold may be a measurement of capacitance with of the relative dielectric constant at the sensor is less than 10 or a change in the capacitance that is greater than 30%.

In other examples, the sensor 180 may also be a mechanical sensor that detects surface roughness or pipe diameter such as a profilometer. The sensor 180 can be an acoustic sensor such as a non-contacting profiler that measures the surface shape. An electromagnetic acoustic transducer can measure the vibrational attenuation that occurs due to scale deposition. In the embodiment shown in FIG. 1, the sensor 180 is positioned on a front end (downhole end) of the wellbore cleaner 140, but there may also be an additional sensor positioned at a rear (uphole) end of the wellbore cleaner 140 near the power source 145. The sensor positioned at the read/uphole end of the wellbore cleaner may be used to measure for the effectiveness of the scale removal of the wellbore cleaner 140. Cleaning on an as-needed basis determined by the initiate-cleaning attribute and/or according to determined intervals may lessen interference with production flow from the wellbore cleaner 140 and may extend a life span of the wellbore cleaner by lessening exposure of the wellbore cleaner to heat in the wellbore during production flow.

Figure 2:
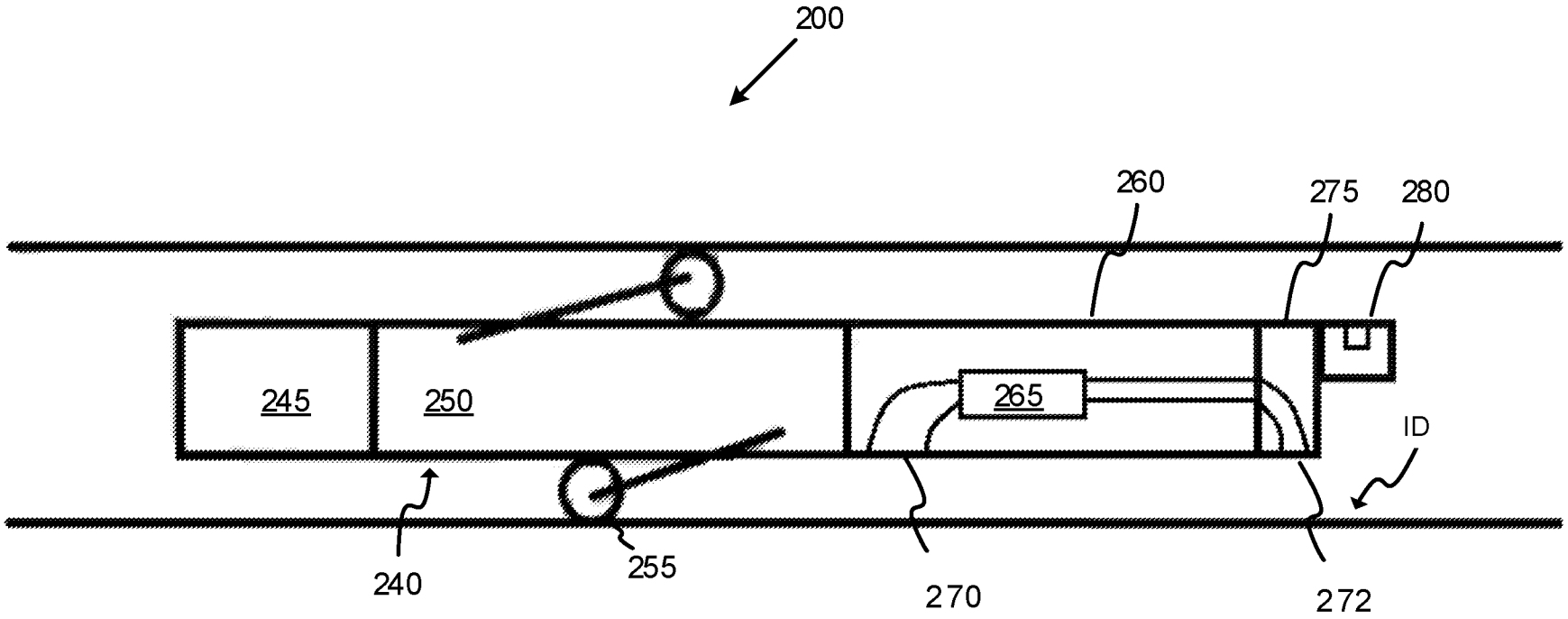
FIG. 2 is a cross-section view of another example of a wellbore cleaning device, according to some embodiments.

FIG. 2 illustrates another embodiment of a wellbore cleaner 240 in a wellbore system 200 manufactured and designed according to the disclosure. The wellbore system 200 and wellbore cleaner 240) share many elements with the wellbore system 100 and wellbore cleaner 240) illustrated in FIG. 1. Accordingly, like reference numerals may be used to indicate similar, if not identical, features. In the particular embodiment of FIG. 2, the wellbore cleaner 240 includes a jet scale remover 260 coupled with motor 250 and power source 245. The jet scale remover 260 may include a pump 265 and a water jet 270.

Some embodiments of the wellbore cleaner 240 may also include a scale removal head. In one embodiment, scale is removed with the pump 265 that blasts water at the inner diameter (ID) of the wellbore. The fluid or water may be drawn into the pump 260 through inlet and filter 270) and then the fluid or water is blasted out of jet 272 at an acute angle to aid in the removal of scale. A preferred angle is between about 20 degrees and about 70 degrees. The preferred angle is one that removes the brittle scale with minimal damage to the ID, which may include ductile steel. In some cases, the water jet 272 aims back towards the remover 260 so that the rebounding fluid/water may help clean the robot. With a single jet, it may be placed on a rotating head 275. The head 275 may either be motorized or may be induced to rotate by the pressure from the exiting jet 272. The jet 272 may be positioned at a slight offset angle which creates a torque that makes the head 275 rotate.

Figure 3:
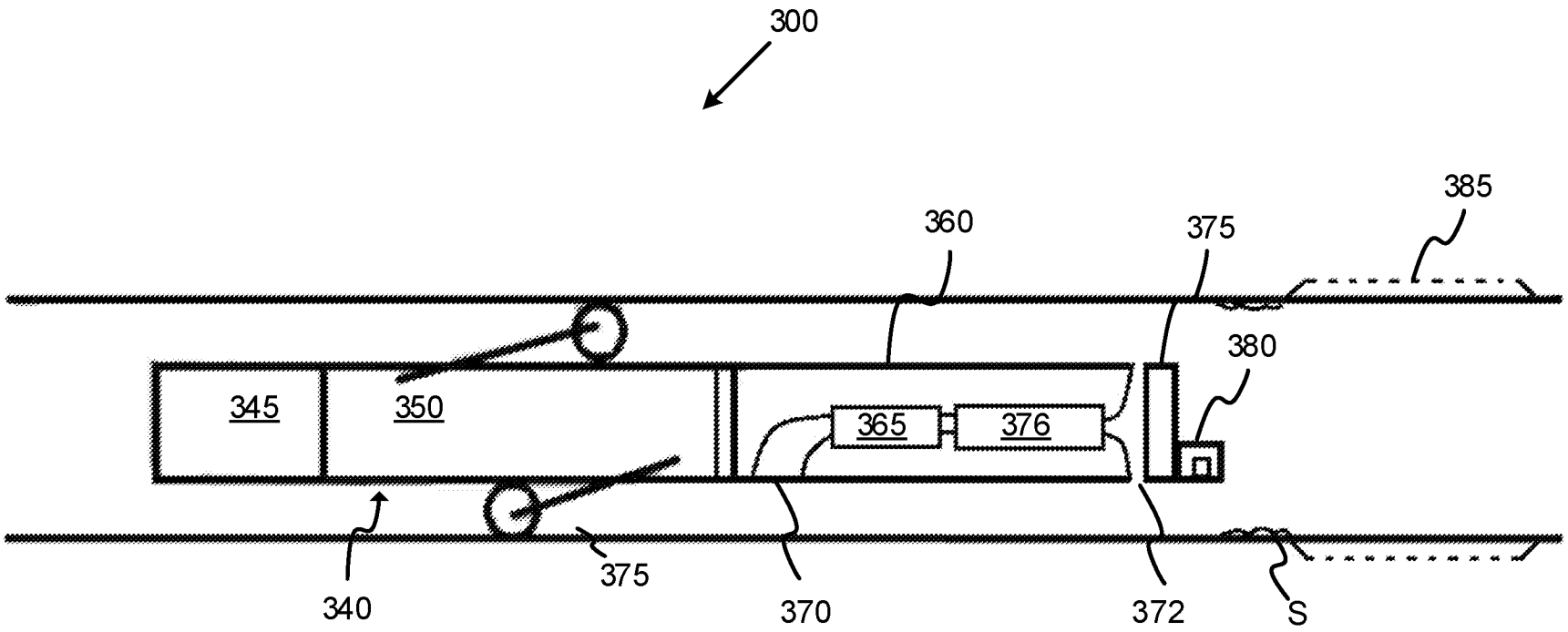
FIG. 3 is a cross-section view of yet another example of a wellbore cleaning device, according to some embodiments.

FIG. 3 illustrates another embodiment of a wellbore cleaner 340 in a wellbore system 300 manufactured and designed according to the disclosure. The wellbore system 300 and wellbore cleaner 340) share many elements with the wellbore system 100 and wellbore cleaner 140 illustrated in FIG. 1. Accordingly, like reference numerals may be used to indicate similar, if not identical, features. In the particular embodiment of FIG. 3, the wellbore cleaner 340 includes a cleaning tool 360 coupled with motor 350 and power source 345. The cleaning tool 360 may include a pump 365 and a jet 372. The pump 365 receives fluid through inlet and filter 370 and can deliver fluid into an accumulator 376 to help smooth the flow. The fluid may exit through jet 372 which may include a fluidic oscillator, such as fluidic oscillator 482 shown in FIG. 4 in order to create a pulsing flow to encourage the scale removal. The exiting fluid can also be used to help displace fines that can clog a mechanical filter of a sandscreen 385.

Figure 4:
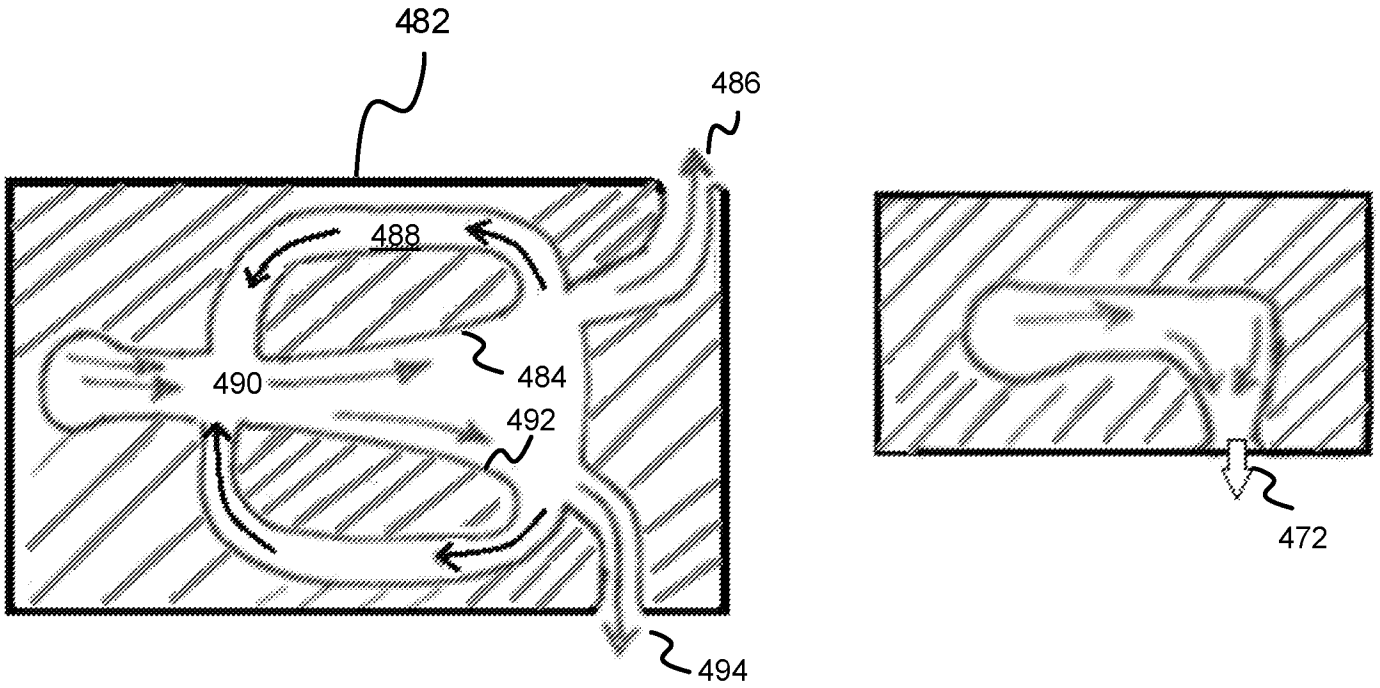
FIG. 4 is a cross-section view of a fluidic oscillator that may be used with examples of the wellbore cleaning device, according to some embodiments.

FIG. 4 is a sectional view of a fluidic oscillator 482 which may be used with at least embodiments of wellbore cleaner 340. The fluidic oscillator 482 operates through fluidic feedback. Flow will tend to follow one wall 484 and following that wall 484 will exit from a flow port 486. A small amount of fluid 488 will flow back on the feedback path to disturb a jet 490 to follow another other wall 492, which will then push fluid out the second flow port 494 while also pushing the jet 490 towards the first wall. The basic concepts of fluidic oscillators is described in U.S. Pat. Nos. 8,844,651 and 7,404,416. As shown in the FIG. 4, in this example, the fluidic oscillator may also use a fluid jet 472. In some embodiments, the fluidic oscillator 482 may also create a vortex.

Figure 5:
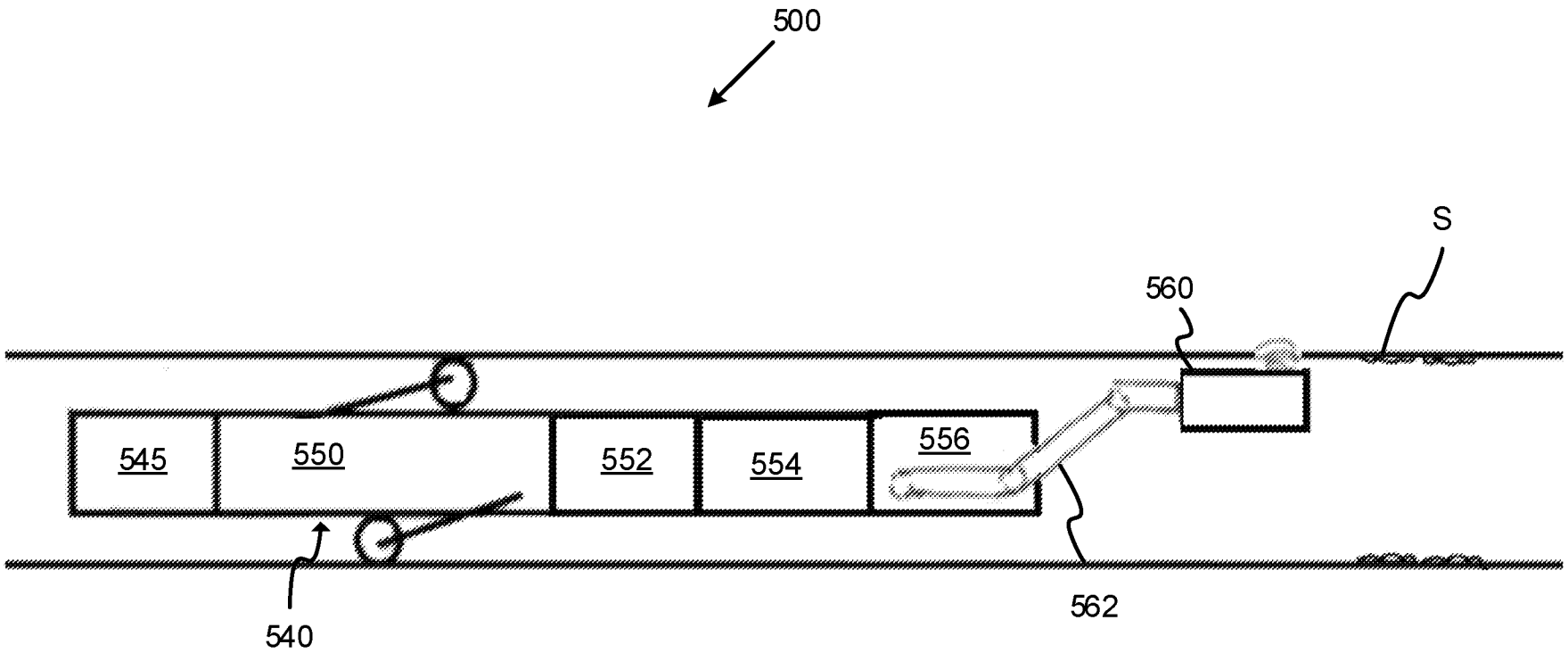
FIG. 5 is a cross-section view of another example of a wellbore cleaning device, according to some embodiments.

FIG. 5 illustrates another embodiment of a wellbore cleaner 540) in a wellbore system 500 manufactured and designed according to the disclosure. The wellbore system 500 and wellbore cleaner 540) share many elements with the wellbore system 100 and wellbore cleaner 140 illustrated in FIG. 1. Accordingly, like reference numerals may be used to indicate similar, if not identical, features. In the particular embodiment of FIG. 5, the wellbore cleaner 540) includes a mechanical member 552, an orienting tool 554, and an arm actuator 556, which may be coupled with the cleaning tool, which in this example is a sonic cleaner 560 via an arm 562. The sonic cleaner 560) uses acoustic energy to remove the scale S. Examples of the sonic cleaner 560 may be a separate tool that can be collected by the wellbore cleaner 540, but may also be integral to the wellbore cleaner 540).

Figure 6:
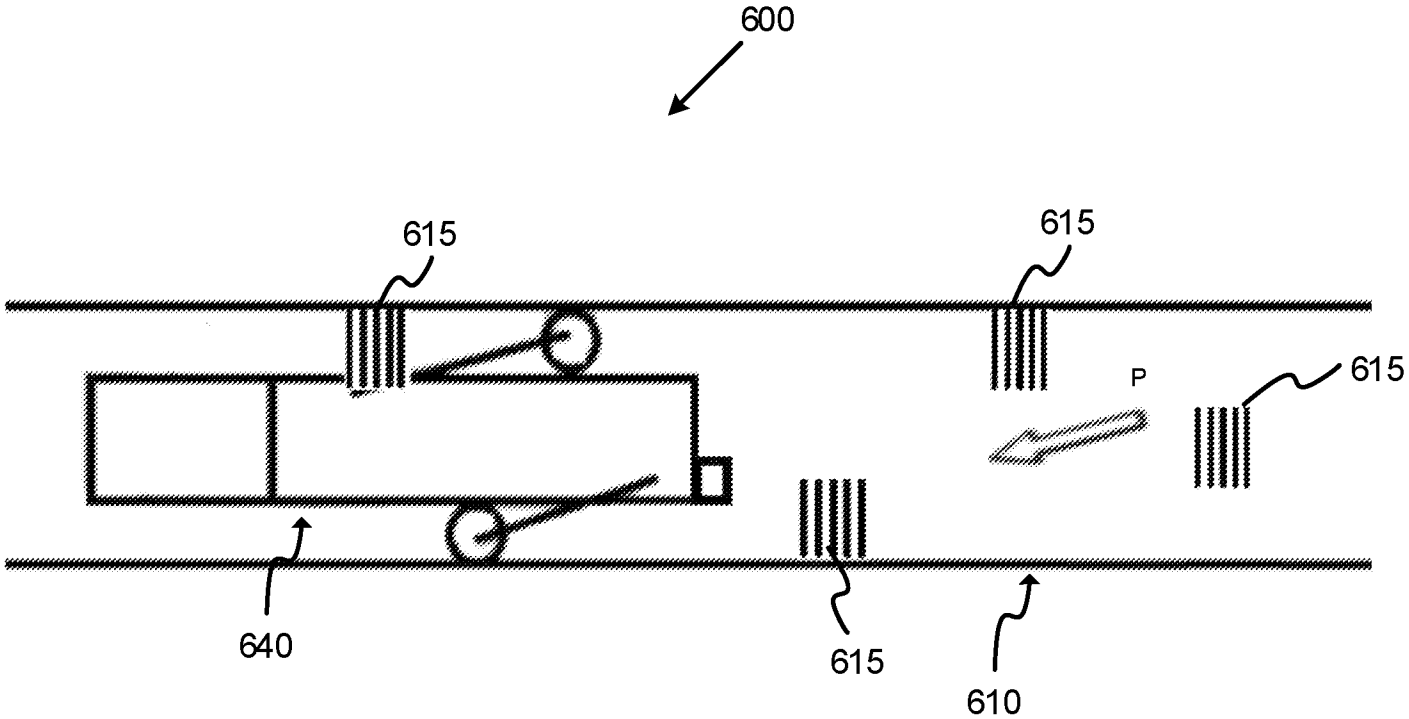
FIG. 6 is a cross-section view of yet another example of a wellbore cleaning device, according to some embodiments.

FIG. 6 illustrates another embodiment of a wellbore system 600 similar to the wellbore systems illustrated in FIGS. 1-3 and FIG. 5. In this embodiment, wellbore system 600 includes a tractor/robot cleaning system 610 manufactured and designed according to the disclosure which may be used to clean an autonomous wellbore cleaner 640 which may be similar to any of the wellbore cleaning systems 140, 240, 340, and 540. The wellbore system 600 and wellbore cleaner 640) share many elements with the wellbore system 100 and wellbore cleaner 140 illustrated in FIG. 1. Accordingly, like reference numerals may be used to indicate similar, if not identical, features. In the particular embodiment of FIG. 6, the robot cleaning system 610 may be run in-hole or already be positioned downhole in a completion 605 of the wellbore. The robot cleaning system 610 may include a series of a plurality of brushes 615, which may be mounted within the inner diameter of the wellbore completion 605. As the wellbore cleaner 640 travels axially within the wellbore, the brushes 615 may contact outer surfaces of the wellbore cleaner 640 and remove scale therefrom. The brushes 615 may be offset from each other in order to minimize any pressure drop from the array of brushes. The brushes 615 may be constructed from a polymer, such as, e.g., polyetheretherketone (PEEK), a carbon-fiber composite, or polytetrafluoroethylene (PTFE) so that scale is unlikely to form on the brushes 615. The brushes 615 may also be constructed from metal, such as steel. As shown in FIG. 6 production flow P may flow in and around brushes 615 of the tractor/robot cleaning system 610.

Figure 7:
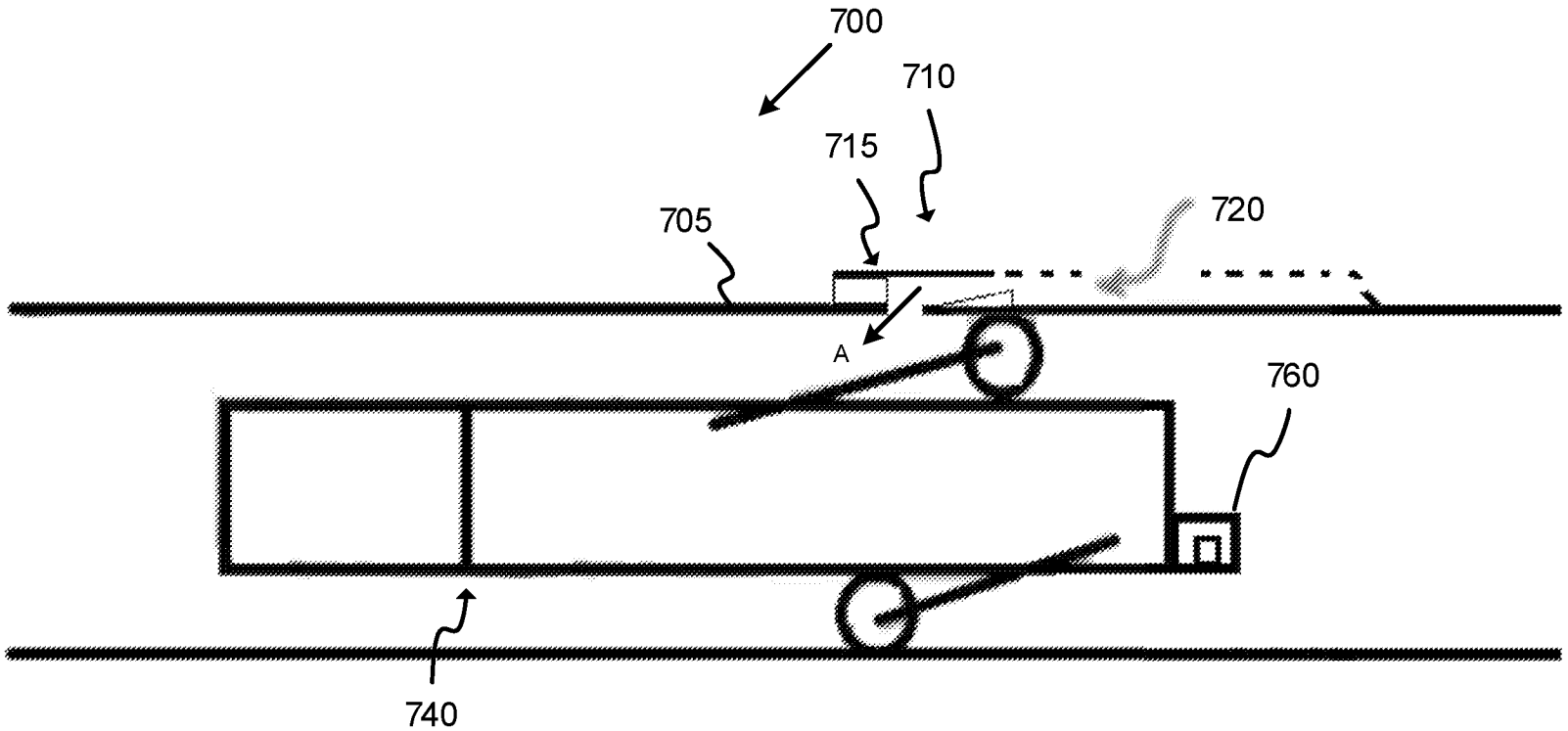
FIG. 7 is a cross-section view of still another example of a wellbore cleaning device, according to some embodiments.

FIG. 7 illustrates another embodiment of a wellbore system 700 similar to the wellbore systems illustrated in FIGS. 1-3 and FIG. 5. In this embodiment, wellbore system 700 includes a tractor/robot cleaning system 710 manufactured and designed according to the disclosure which may be used to clean an autonomous wellbore cleaner 640 which may be similar to any of the wellbore cleaning systems 140, 240, 340, and 540. The wellbore system 600 and wellbore cleaner 640) share many elements with the wellbore system 100 and wellbore cleaner 140 illustrated in FIG. 1. Accordingly, like reference numerals may be used to indicate similar, if not identical, features. In the particular embodiment of FIG. 7, the tractor/robot cleaning system 710 includes a jet 715 created by the flow 720 entering the production tubing 705. The jet 715 may include a nozzle, a vortex, a fluidic oscillator, or equivalent. In this example, the jet 715 impinges at an angle A relative to the wellbore cleaner to the robot to remove any scale from the wellbore cleaner.

In some embodiments, the initiate-cleaning attribute which may be detected by sensor 780 on the wellbore cleaner 740 may also be used to initiate movement of the wellbore cleaner 740 through the tractor/robot cleaning system 710 for scale removal from the wellbore cleaner, in addition to removing scale from within the tubing 705.

Figure 8:
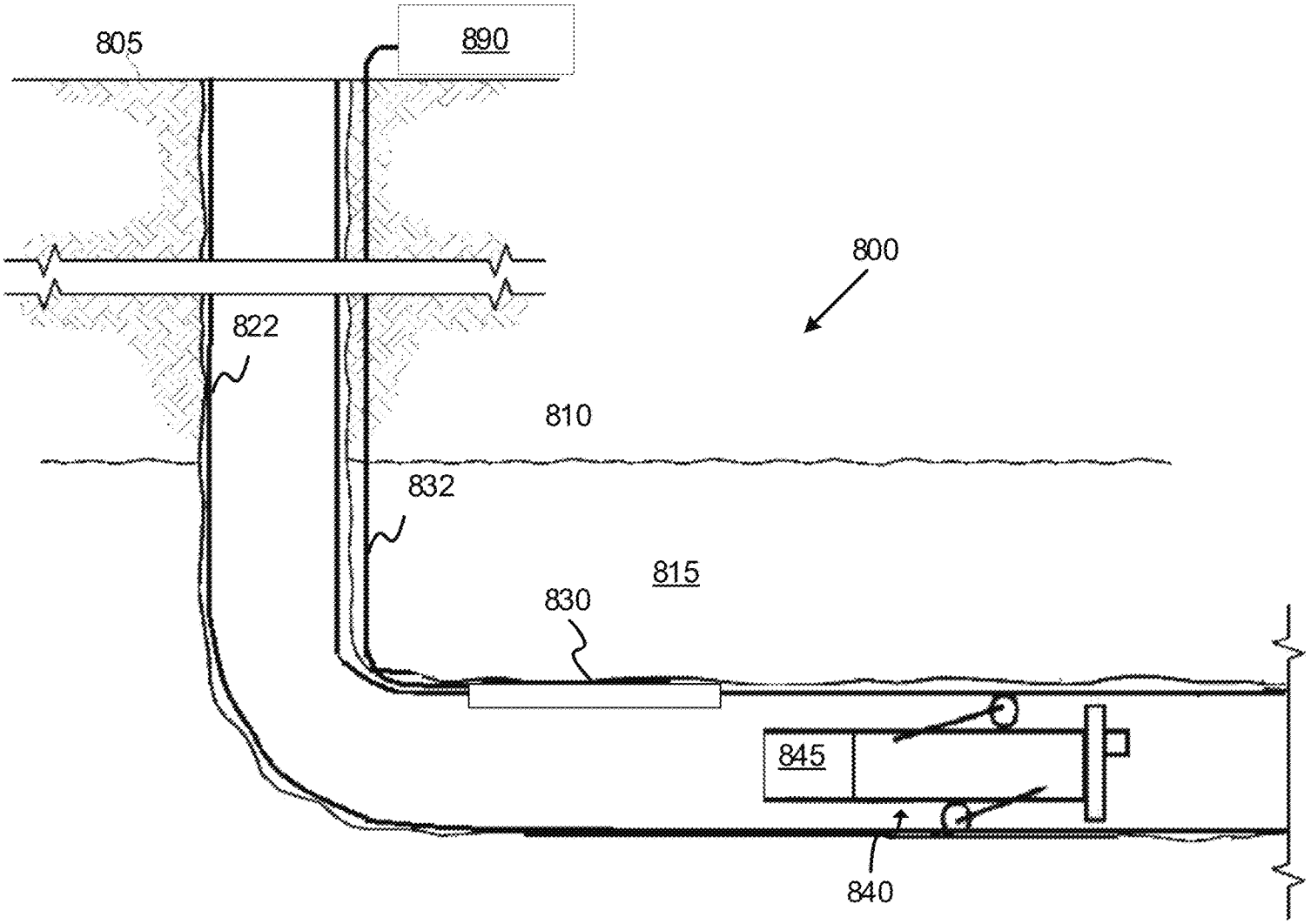
FIG. 8 is a partial cross-section view of another example wellbore system, according to some embodiments.

FIG. 8 illustrates another embodiment of a wellbore system 800 having casing 822 and similar to the wellbore system 100 illustrated in FIG. 1. In this embodiment, wellbore system 800 includes a docking station 830 which may be positioned in wellbore 805 and used with autonomous wellbore cleaner 840 which may be similar to any of wellbore cleaning system 140, 240, 340, and 540. The wellbore system 800 and wellbore cleaner 640 share many elements with the wellbore system 100 and wellbore cleaner 140 illustrated in FIG. 1. Accordingly, like reference numerals may be used to indicate similar, if not identical, features. In the particular embodiment of FIG. 8, the docking station 830 may receive wellbore cleaner 840 for docking when the wellbore cleaner is moving within the wellbore 805. The docking station 830 may be a pocket within the wellbore for housing the wellbore cleaner to keep the wellbore cleaner out of the production flow path when not in motion or use. In some embodiments, the docking station 830 may also function as a charging station for recharging power supply 845 of wellbore cleaner. The docking station 830 may also be communicatively coupled with processor 890. In some examples, a power line 832 may connect the docking station 830 with the processor 890. In other examples, the docking station 830 may also be integrated as part of a tractor/robot cleaning system, such as tractor/robot cleaning system 610 or 710.

Example Operations

Figure 9:
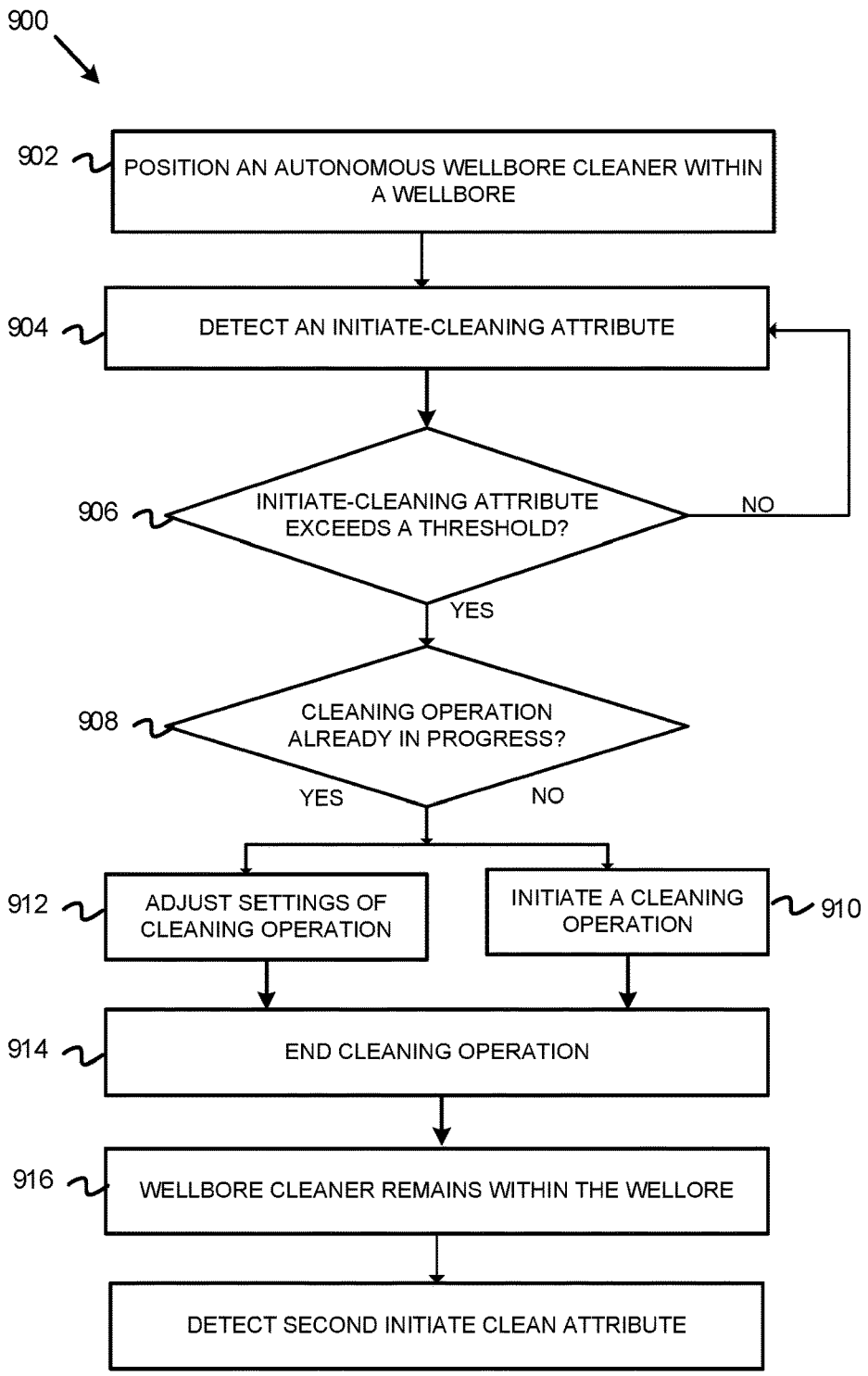
FIG. 9 is a flowchart illustrating a method for cleaning a wellbore, according to some embodiments.

FIG. 9 depicts a flowchart of example operations for activating and de-activating a cleaning tool, according to some embodiments. In particular, FIG. 9 depicts a flowchart 900 of example operations for positioning, activating, and operating an autonomous wellbore cleaning device within a wellbore. Operations of the flowchart 900 can be performed by software, firmware, hardware, or a combination thereof. Operations of the flowchart 900 are described in reference to the example wellbore system 100 of FIG. 1 and the example wellbore cleaners 140, 240, 340, 540, and 640, 740, and 840 of FIGS. 1-3 and 5-8. However, other systems and components may be used to perform the operations now described. The operations of the flowchart 900 start at block 902.

At block 902, an autonomous wellbore cleaner is positioned downhole in a wellbore. The wellbore cleaner may be positioned into the wellbore by a workstring, but once placed, the wellbore cleaner is untethered or physically connected to any features uphole or at the surface.

At block 904, at least one sensor of the wellbore cleaner detects an initiate-cleaning attribute. The initiate-cleaning attribute may indicate a certain amount of scale build up within the inner diameter of the wellbore, may indicate a reduction in velocity of movement by the wellbore cleaner as it moves axially, or may be an electrical indication of a change in resistance or capacitance.

At block 906, a processor receives the initiate-cleaning attribute and determines whether the initiate-cleaning attribute exceeds a threshold. The threshold may be scale buildup greater than a specified amount, such as 1 mm of scale buildup in certain environments. The threshold may also be a specified percentage of reduction in velocity, or change in electrical reading or certain amounts. For example, the initiate-cleaning attribute and threshold may be a specified electrical resistivity, such as resistivity greater than 0.0001 ohmmeter. The threshold may be a specified change in electrical resistivity, such as the resistivity increasing by 2×. The threshold may also be a measurement of capacitance with of the relative dielectric constant at the sensor is less than 10 or a change in the capacitance that is greater than 30%.

If the initiate-cleaning attribute does not exceed the threshold, the wellbore cleaner continues normal operation or remains stationary and the sensor continues to operate and detect initiate-cleaning attributes.

If the initiate-cleaning attribute exceeds the threshold, then the operation continues at block 908. At block 908, a determination is made whether a cleaning operation is already in progress. If no, then a cleaning operation is initiated at block 910. In some examples, the initiate cleaning operation may include sending the wellbore cleaner into the wellbore to initiate a new cleaning operation. If yes, then adjustments may be made to settings of the wellbore cleaner at block 912, such as, e.g., adjusting a pressure setting of the cleaning tool as discussed in various examples herein.

At block 914, once the cleaning operation is complete, after either a certain passage of time or the initiate-cleaning attribute falling below the threshold, then the cleaning operation ends. And at block 916, the wellbore cleaner remains in the wellbore. The wellbore cleaner may return to a docking station positioned within a completion of the wellbore.

FIG. 9 is annotated with a series of numbers 902-916. These numbers represent stages of operations. Although these stages are ordered for this example, the stages illustrate one example to aid in understanding this disclosure and should not be used to limit the claims. Subject matter falling within the scope of the claims can vary with respect to the order and some of the operations.

The flowcharts are provided to aid in understanding the illustrations and are not to be used to limit the scope of the claims. The flowcharts depict example operations that can vary within the scope of the claims. Additional operations may be performed: fewer operations may be performed: the operations may be performed in parallel: and the operations may be performed in a different order. For example, the operations depicted in blocks 904-908 may be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Example Computer

Figure 10:
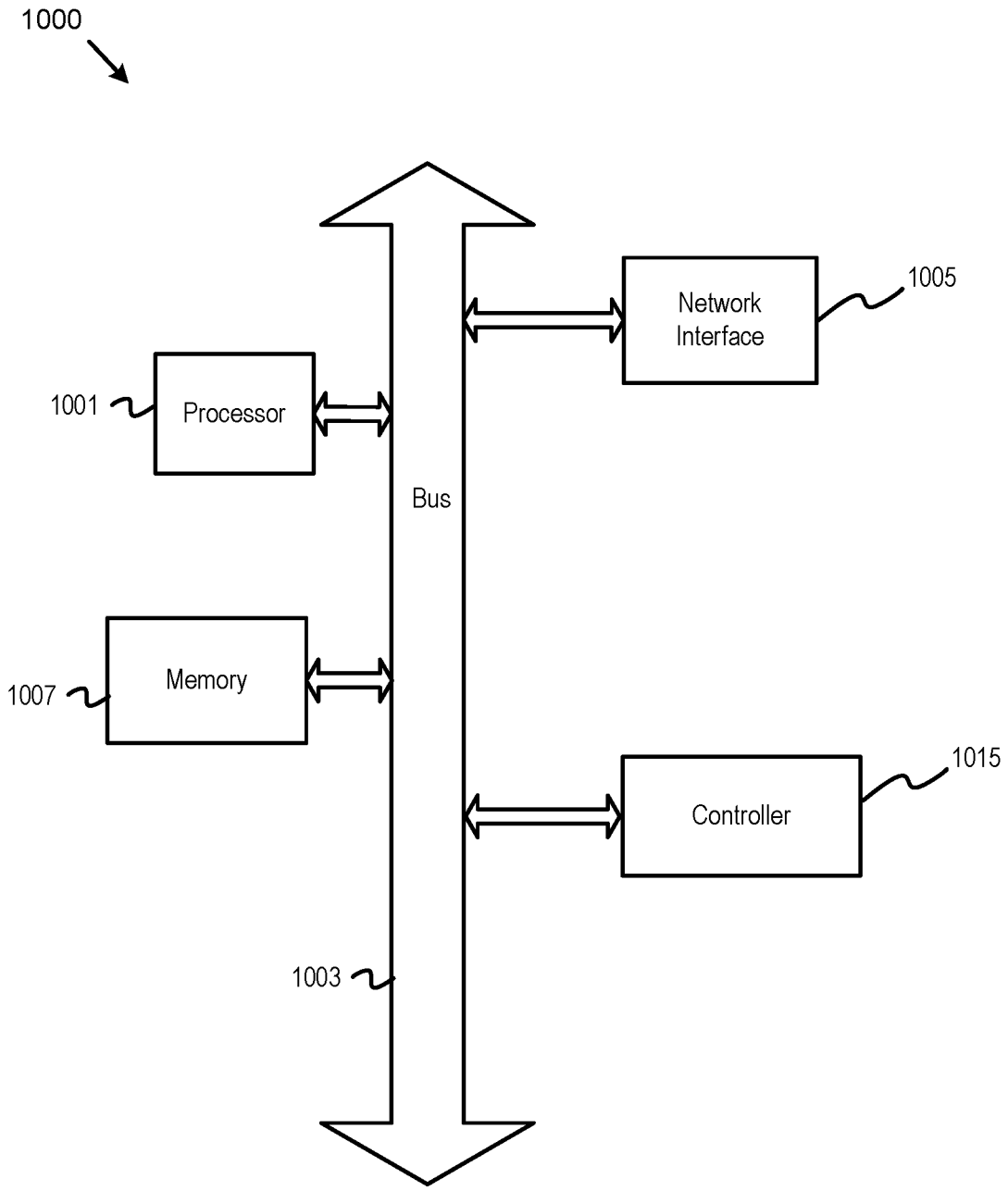
FIG. 10 is an example computer, according to some embodiments.

FIG. 10 depicts an example computer, according to some embodiments. A computer 1000 includes a processor 1001 (possibly including multiple processors, multiple cores, multiple nodes, and/or implementing multi-threading, etc.). The computer 1000 includes a memory 1007. The memory 1007 may be system memory or any one or more of the above already described possible realizations of machine-readable media. The computer 1000 also includes a bus 1003 and a network interface 1005. The computer 1000 may, in some examples, may perform the functions of the processor 190 shown and described in FIG. 1.

The system also includes a controller 1011. The controller 1011 may perform one or more operations depicted in FIG. 9. For example, the processor 1001 may process signals received from the sensor 180 and the controller 1011 may remotely interface with the wellbore cleaner. Any one of the previously described functionalities may be partially (or entirely) implemented in hardware and/or on the processor 1001. For example, the functionality may be implemented with an application specific integrated circuit, in logic implemented in the processor 1001, in a co-processor on a peripheral device or card, etc. Further, realizations may include fewer or additional components not illustrated in FIG. 10 (e.g., video cards, audio cards, additional network interfaces, peripheral devices, etc.). The processor 1001 and the network interface 1005 are coupled to the bus 1003. Although illustrated as being coupled to the bus 1003, the memory 1007 may be coupled to the processor 1001.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Aspects disclosed herein include:

Aspect A: An apparatus for cleaning a wellbore, the apparatus comprising: an autonomous robot, wherein the robot is self-propelled: a power source for the robot: a motor for propelling the robot axially within the wellbore: at least one cleaning tool positioned on the robot: at least one sensor to detect an initiate-cleaning attribute downhole in the wellbore; and a processor to direct the robot to initiate a cleaning operation in response to the initiate-cleaning attribute exceeding a threshold.

Aspect B: A system comprising: a wellbore: a cleaning apparatus positioned in the wellbore, the cleaning apparatus including: an autonomous robot, wherein the robot is self-propelled; a power source for the robot: a motor for propelling the robot axially within the wellbore: at least one cleaning tool positioned on the robot: at least one sensor to detect an initiate-cleaning attribute downhole in the wellbore: and a processor to direct the robot to initiate a cleaning operation in response to the initiate-cleaning attribute exceeding a threshold.

Aspect C: A method comprising: positioning into a wellbore, an autonomous cleaning apparatus, the autonomous cleaning apparatus including: a robot, wherein the robot is self-propelled; a power source for the robot: a motor for propelling the robot axially within the wellbore: at least one cleaning tool positioned on the robot: and at least one sensor: detecting an initiate-cleaning attribute by the at least one sensor: and initiating, by a processor, a cleaning operation by the autonomous cleaning apparatus in response to the sensor detecting the initiate-cleaning attribute.

Aspects A, B, and C may have one or more of the following additional elements in combination:

Element 1: wherein the sensor is one of a scale sensor and a restriction sensor.

Element 2: wherein the robot is untethered once positioned downhole.

Element 3: wherein the initiate-cleaning attribute indicates an amount of scale build up within an inner diameter of the wellbore.

Element 4: wherein the initiate-cleaning attribute indicates an adjustment is needed to an existing cleaning operation, wherein the adjustment includes one of a change in speed of movement of the robot within the wellbore and a change in cleaning intensity of the robot.

Element 5: wherein the initiate-cleaning attribute indicates an amount of time has passed after a previous cleaning operation.

Element 6: wherein the initiate-cleaning attribute indicates the robot needs to be directed into the wellbore to initiate a cleaning operation.

Element 7: wherein the cleaning tool is one of a brush, a sonic cleaner, and a water jet.

Element 8: wherein the robot is configured to return to a docking station within a completion of the wellbore.

Element 9: further comprising a docking station for the robot within a completion of the wellbore.

Element 10: wherein the docking station includes a charging station for the power source.

Element 11: wherein the initiate-cleaning attribute indicates one of an amount of scale build up within an inner diameter of the wellbore: an adjustment is needed to an existing cleaning operation, that a predetermined amount of time has passed after a previous cleaning operation, and that the robot needs to be directed into the wellbore to initiate a cleaning operation.

Element 12: wherein the adjustment needed to an existing cleaning operation includes one of stopping a current operation, adjusting a cleaning intensity, and a change in speed of movement of the robot within the wellbore.

Element 13: wherein the wellbore includes cleaning components positioned downhole for cleaning the cleaning apparatus downhole.

Element 14: wherein the initiate-cleaning attribute is one of: an indication of an amount of scale build up within an inner diameter of the wellbore; an indication that an adjustment is needed to an existing cleaning operation, wherein the adjustment is one of a change in speed of movement of the robot within the wellbore and a change in intensity of the existing cleaning operation; an indication that a predetermined amount of time has passed after a previous cleaning operation; and an indication that the robot needs to be sent into the wellbore to initiate a cleaning operation.

Element 15: further comprising: detecting by the processor, that the power source is below a predetermined charge level; and directing the robot to a charging station within the wellbore to recharge.

What is claimed is:

1. An apparatus for cleaning a wellbore, the apparatus comprising:

an autonomous robot, wherein the robot is self-propelled;

a power source for the robot;

a motor for propelling the robot axially within the wellbore;

at least one cleaning tool positioned on the robot;

at least one sensor to detect an initiate-cleaning attribute downhole in the wellbore; and a processor to direct the robot to initiate a cleaning operation in response to the initiate-cleaning attribute exceeding a threshold, wherein the threshold is based on at least one of a depth of scale, an amount of coverage of scale, a change in an electrical reading, or a change in speed of movement.

2. The apparatus according to claim 1, wherein the sensor is one of a scale sensor and a restriction sensor.

3. The apparatus according to claim 1, wherein the robot is untethered once positioned downhole.

4. The apparatus according to claim 1, wherein the initiate-cleaning attribute indicates an amount of scale build up within an inner diameter of the wellbore.

5. The apparatus according to claim 1, wherein the initiate-cleaning attribute indicates an adjustment is needed to an existing cleaning operation, wherein the adjustment includes one of a change in speed of movement of the robot within the wellbore and a change in cleaning intensity of the robot.

6. The apparatus according to claim 1, wherein the initiate-cleaning attribute indicates an amount of time has passed after a previous cleaning operation.

7. The apparatus according to claim 1, wherein the initiate-cleaning attribute indicates the robot needs to be directed into the wellbore to initiate a cleaning operation.

8. The apparatus according to claim 1, wherein the cleaning tool is one of a brush, a sonic cleaner, and a water jet.

9. The apparatus according to claim 1, wherein the robot is configured to return to a docking station within a completion of the wellbore.

10. A system comprising:

a wellbore;

a cleaning apparatus positioned in the wellbore, the cleaning apparatus including:

an autonomous robot, wherein the robot is self-propelled;

a power source for the robot;

a motor for propelling the robot axially within the wellbore;

at least one cleaning tool positioned on the robot;

at least one sensor to detect an initiate-cleaning attribute downhole in the wellbore; and a processor to direct the robot to initiate a cleaning operation in response to the initiate-cleaning attribute exceeding a threshold, wherein the threshold is based on at least one of a depth of scale, an amount of coverage of scale, a change in an electrical reading, or a change in speed of movement.

11. The system according to claim 10, further comprising a docking station for the robot within a completion of the wellbore.

12. The system according to claim 11, wherein the docking station includes a charging station for the power source.

13. The system according to claim 10, wherein the robot is untethered once the cleaning apparatus is positioned within the wellbore.

14. The system according to claim 10, wherein the sensor is one of a scale sensor and a restriction sensor.

15. The system according to claim 10, wherein the initiate-cleaning attribute indicates one of an amount of scale build up within an inner diameter of the wellbore, an adjustment is needed to an existing cleaning operation, that a predetermined amount of time has passed after a previous cleaning operation, and that the robot needs to be directed into the wellbore to initiate a cleaning operation.

16. The system according to claim 15, wherein the adjustment needed to an existing cleaning operation includes one of stopping a current operation, adjusting a cleaning intensity, and a change in speed of movement of the robot within the wellbore.

17. The system according to claim 10, wherein the wellbore includes cleaning components positioned downhole for cleaning the cleaning apparatus downhole.

18. A method comprising:

positioning into a wellbore, an autonomous cleaning apparatus, the autonomous cleaning apparatus including:

a robot, wherein the robot is self-propelled;

a power source for the robot;

a motor for propelling the robot axially within the wellbore;

at least one cleaning tool positioned on the robot; and at least one sensor;

detecting an initiate-cleaning attribute by the at least one sensor;

determining, by a processor, whether the initiate-cleaning attribute exceeds a threshold, wherein the threshold is based on at least one of a depth of scale, an amount of coverage of scale, a change in an electrical reading, or a change in speed of movement; and initiating, by the processor, a cleaning operation by the autonomous cleaning apparatus in response to determining that the initiate-cleaning attribute exceeds the threshold.

19. The method according to claim 18, wherein the initiate-cleaning attribute is one of:

an indication of an amount of scale build up within an inner diameter of the wellbore;

an indication that an adjustment is needed to an existing cleaning operation, wherein the adjustment is one of a change in speed of movement of the robot within the wellbore and a change in intensity of the existing cleaning operation;

an indication that a predetermined amount of time has passed after a previous cleaning operation; and an indication that the robot needs to be sent into the wellbore to initiate a cleaning operation.

20. The method according to claim 18, further comprising:

detecting by the processor, that the power source is below a predetermined charge level; and directing the robot to a charging station within the wellbore to recharge.

* * * * *